US006398089B1

(12) United States Patent
Har-Shen

(10) Patent No.: US 6,398,089 B1
(45) Date of Patent: Jun. 4, 2002

(54) HOLSTER FOR A HAND GUN AND A MAGAZINE

(75) Inventor: Chanan Har-Shen, Kfar Hess (IL)

(73) Assignee: Fobus International Ltd. (IL)

( * ) Notice: Subject to any disclaimer, the term of this patent is extended or adjusted under 35 U.S.C. 154(b) by 0 days.

(21) Appl. No.: 09/546,506

(22) Filed: Apr. 11, 2000

(30) Foreign Application Priority Data

May 29, 1999 (IL) ..... 129683

(51) Int. Cl.[7] ..... F41C 33/00

(52) U.S. Cl. ..... 224/192; 224/912

(58) Field of Search ..... 224/192, 243, 224/912, 238, 239, 667, 668

(56) References Cited

U.S. PATENT DOCUMENTS

| | | | | | |
|---|---|---|---|---|---|
| 4,971,236 | A | * | 11/1990 | Grummet | 224/192 X |
| 5,176,302 | A | * | 1/1993 | Smith | 224/667 X |
| 5,303,860 | A | * | 4/1994 | Serafini, Jr. | 224/243 X |
| 5,322,200 | A | * | 6/1994 | Blanchard | 224/192 |
| 5,551,611 | A | * | 9/1996 | Gilmore | 224/192 X |
| 5,865,357 | A | * | 2/1999 | Goodwin | 224/667 X |
| 6,161,741 | A | * | 12/2000 | French | 224/192 X |

* cited by examiner

*Primary Examiner*—Gregory M. Vidovich
*Assistant Examiner*—Maerena W. Brevard
(74) *Attorney, Agent, or Firm*—Fulbright & Jaworski L.L.P.

(57) ABSTRACT

The invention provides a rigid plastic hand gun holster, comprising a rigid plastic holster having inner dimensions complementary to the configuration of the outer sections of a hand gun to be placed therein, wherein the holster is a product of injection molding.

20 Claims, 3 Drawing Sheets

FIG. 3
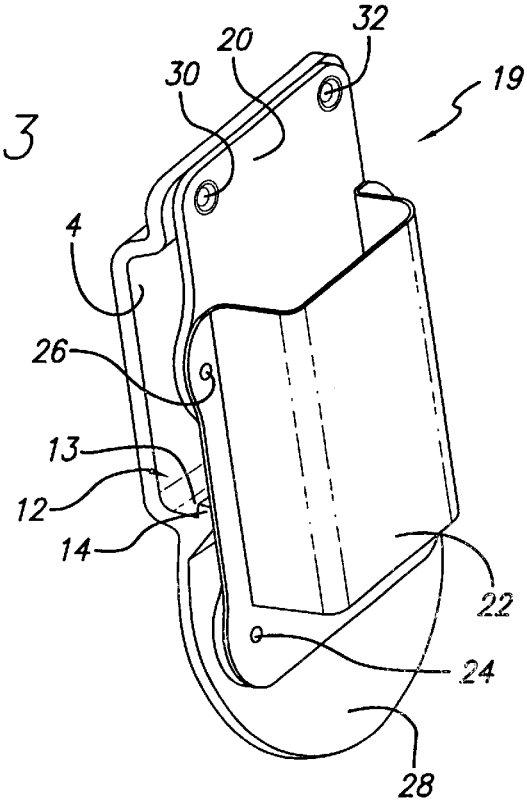
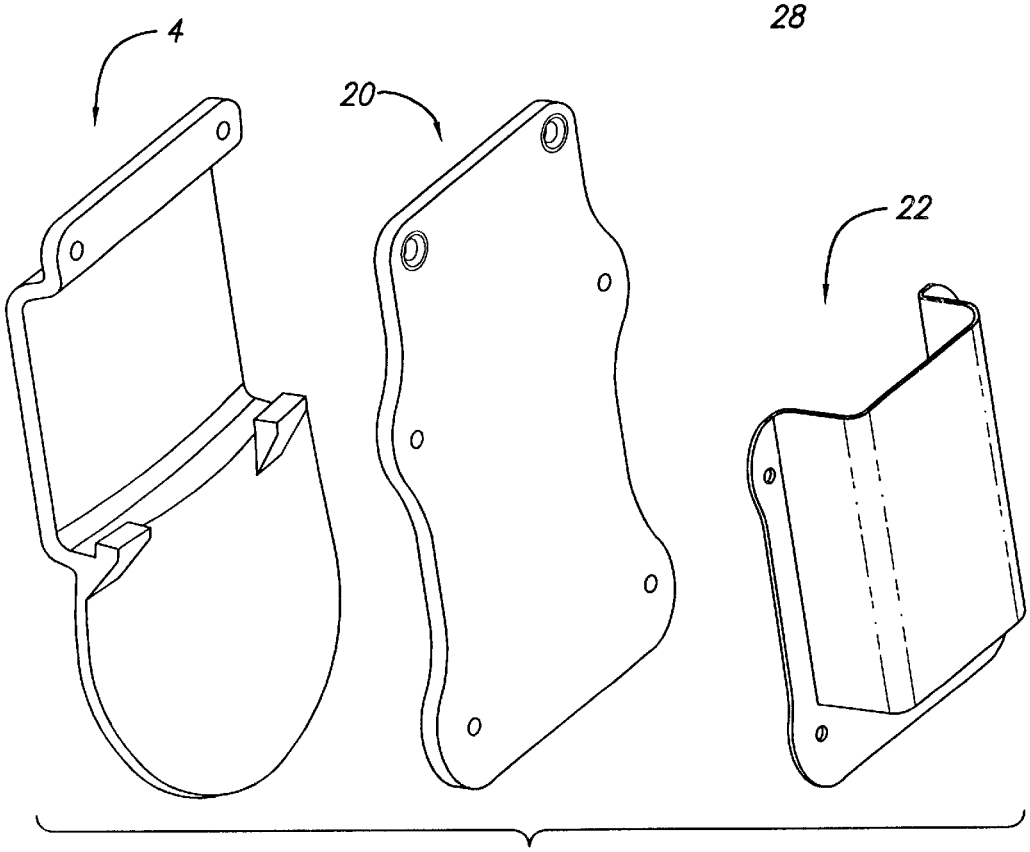
FIG. 4

HOLSTER FOR A HAND GUN AND A MAGAZINE

FIELD OF INVENTION

The present invention relates to a rigid plastic hand gun holster and a rigid plastic holster for holding a magazine.

BACKGROUND OF THE INVENTION

Numerous types of gun holsters are known in the art. Traditionally, gun holsters, as well as pouches which hold magazines, are made of leather. Leather is a relatively durable material which can be used to manufacture a hand gun holster suitable for receiving different models and configurations of hand guns. Therefore, a hand gun owner could use a gun holster which was not specifically designed for the specific model in his possession, however, with time, the leather holster would roughly adapt its configuration to that of the hand gun within it. After the shape adaptation took place the hand gun user was not always satisfied with the leather holster's ability to, on one hand, hold the gun within it and, on the other hand, allow for the quick draw therefrom.

Since the leather is susceptible to external forces such as exposure to moisture, expansion and contraction, due to temperature changes, and wear and tear effects, the holster's inner configuration is slightly different at various points in time. The difference, over time, in the holster's inner shape consequentially influences the gripping relationship between the gun and the holster and may be detrimental for some hand gun users. A police officer which is required on occasion to draw the hand gun in a quick fashion, can't allow or accept a situation whereby upon attempting to swiftly remove the hand gun, he finds the holster attached to the gun in his hand, thereby interfering with the next step of loading and/or discharging the weapon. The above situations occur under conditions in which a leather holster is clipped to the user's pants or belt, rather than being threaded through said belt, and in which an expansion of the holster has taken place to the extent that the gripping power between the holster and the hand gun were greater than the gripping power between the holster and the user's pants.

A hand gun holster, as well as a magazine holster (pouch), requires the unique characteristics which should include, on one hand, the ability to securely grip the hand gun when placed therein, eliminating the possibility, for example, of the hand gun falling out in a case where the holster is placed in a downwardly angle due, for example, to the bending over of the user and, on the other hand, to allow for the quick draw of said gun without any interference.

The present inventor has therefore attempted to overcome the above shortcomings by providing a holster which has specific inner dimensions for receiving a hand gun or magazine, whereby the holster would have a predetermined gripping relationship with the gun or the magazine, thereby eliminating shape variations resulting from external forces such as temperature and moisture. Furthermore, in the present invention injection molding technology is used to allow each and every removal of a hand gun from a rigid plastic holster to be met with the same resistance, implemented by the same amount of force.

SUMMARY OF INVENTION

It is therefore the object of the present invention to provide a rigid plastic hand gun holster, comprising a rigid plastic holster having inner dimensions complementary to the configuration of the outer sections of a hand gun to be placed therein, wherein said holster is a product of injection molding.

In a preferred embodiment of the present invention the holster comprises two rigid plastic panels.

In a further preferred embodiment of the present invention at least one of said panels is provided with an indentation corresponding to the position of an opening of a trigger guard of a hand gun positioned therein, whereby said indentation releasably interlocks with said trigger guard to form a snap-fit therewith.

In especially preferred embodiments of the present invention the cross-section of at least a segment of each of the panels is of substantially hook-shaped configuration.

Preferably the panels are connected by means selected from the group consisting of rivets, glue and the application of ultrasonic welding thereto.

In preferred embodiments of the present invention the holster further comprises a retention member for mounting said holster on the upper rim of the users pants, wherein said retention member has a lateral concave configuration complementary to the convex configuration of said user's hip, wherein said retention member has a lateral step configuration along the longitudinal axis thereof, whereby said step forms a ledge that can underride a belt, and wherein the ledge of said step further comprises at least two spaced-apart upwardly-extending flanges for hooking against the front surface of said belt, thereby enabling said belt to act as stop means preventing upward movement of said holster, while allowing the quick draw of a gun therefrom.

In an especially preferred embodiment, the above flanges form a pair of spaced-apart hook-like configurations.

In a preferred embodiment the retention member is made of rigid plastic and is connected to the holster by means selected from the group consisting of rivets, glue and ultrasound.

In a further embodiment of the present invention the cross-section of at least a segment of said holster is substantially rectangular.

In another aspect of the invention there is provided a rigid plastic holster for holding a magazine for an automatic hand gun, comprising a rigid plastic holster having inner dimensions complementary to the configuration of the outer sections of a magazine to placed therein, wherein said magazine holster is a product of injection molding.

In a preferred embodiment of the present invention the magazine holster comprises two rigid plastic panels and the panels are connected by means selected from the group consisting of rivets, glue and ultrasound.

In preferred embodiments of the present invention the magazine holster further comprises a retention member for mounting said holster on the upper rim of the user's pants, wherein said retention member has a lateral concave configuration complementary to the convex configuration of said user's hip, wherein said retention member has a lateral step configuration along the longitudinal axis thereof, whereby said step forms a ledge that can underride a belt, and wherein the ledge of said step further comprises at least one upwardly extending flange which is substantially parallel to said member and substantially perpendicular to the ledge of said step, thereby forming a hook-like configuration for hooking against the front surface of said belt, thereby enabling said belt to act as stop means preventing upward movement of said holster, while allowing the quick withdrawal of a magazine therefrom.

While the invention will now be described in connection with certain preferred embodiments in the following figures so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following figures which include preferred embodiments will serve to illustrate the practice of this invention, it being understood that the particulars shown are by way of example and for purposes of illustrative discussion of preferred embodiments of the present invention only and are presented in the cause of providing what is believed to be the most useful and readily understood description of formulation procedures as well as of the principles and conceptual aspects of the invention.

FIG. 3 illustrates a side view of a magazine holster (pouch) in combination with a retention member; and FIG. 4 illustrates an exploded side view of a magazine holster (pouch) and a retention member.

Figure 1:
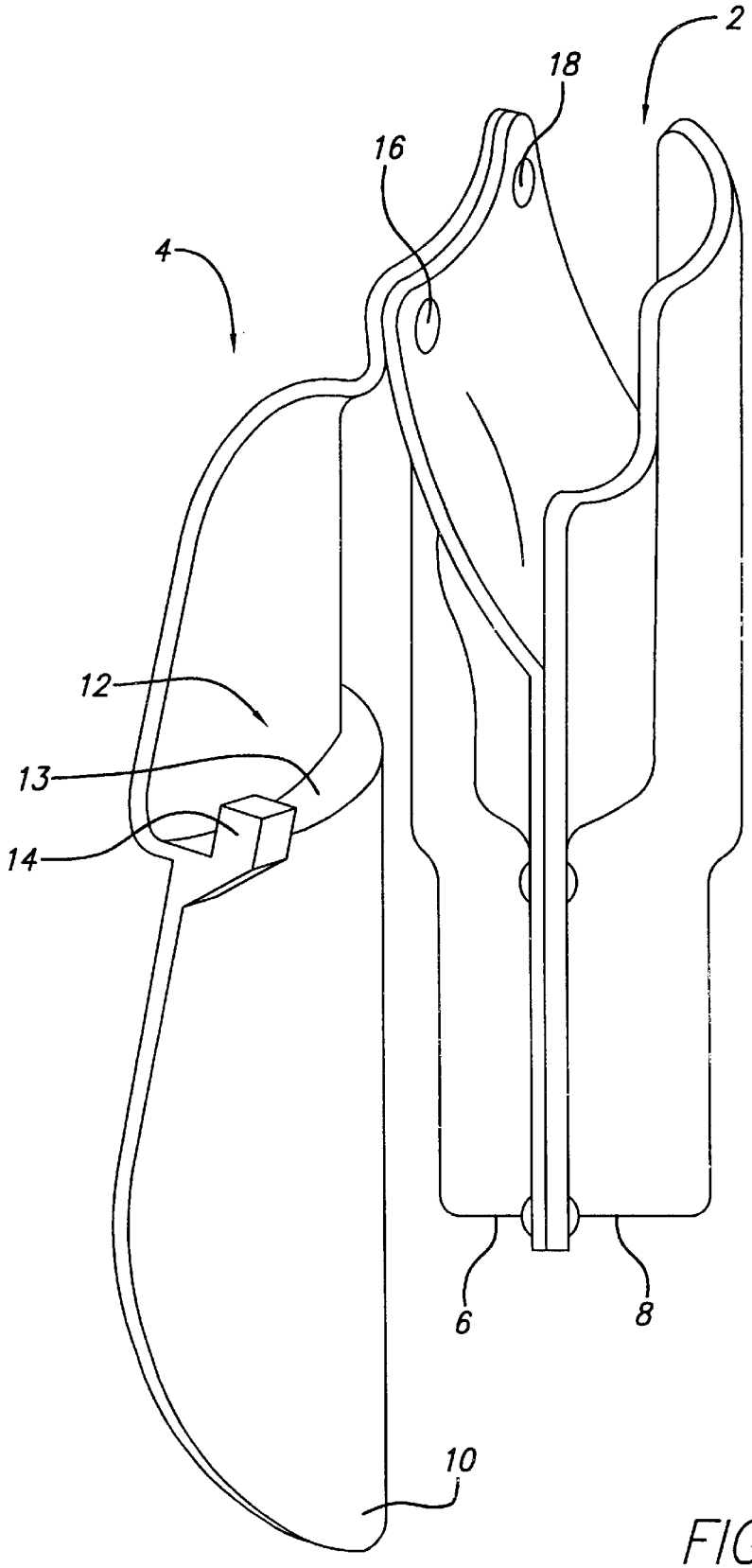
FIG. 1 illustrates a side view of a hand gun holster, in combination with a retention member.

In FIG. 1 there is seen a handgun holster (2) in combination with a retention member (4).

The holster (2) and retention member (4) are products of injection molding. The inner dimensions of the holster (2) are complementary to the configuration of the outer dimensions/sections of a hand gun (not shown), to be placed therein. The holster (2) can be prepared as one piece by injection molding or as two pieces which are then connected to each other. The illustrated holster (2) includes two rigid plastic panels (6) and (8) which are connected by rivets such as (10) and (12). It should be noted that panels (6) and (8) may be connected by glue or the application of ultrasonic welding thereto. The retention member (4) enables the mounting of holster (2) on the upper rim of a user's pants (not shown). The member (4) has a lateral concave configuration (shown is the convex side ((10) of the member), complementary to the convex configuration of a user's hip (not shown).

Retention in member (4) has a lateral step configuration (12) along the longitudinal axis thereof, whereby step (12) forms a ledge (13) that can underride a belt (not shown), and wherein the ledge of said step further comprises at least one upwardly extending flange (14) which is substantially parallel to said member (4) and substantially perpendicular to the ledge (13) of said step, thereby forming a hook-like configuration for hooking against the front surface of said belt, thereby enabling said belt to act as stop means preventing upward movement of said holster, while allowing the quick draw of a gun therefrom.

The holster (2) is connected to retention member (4) by rivets (16) and (18), however may be connected by glue or the application of ultrasonic welding.

In the following drawings similar numerals have been used to designate similar parts.

Figure 2:
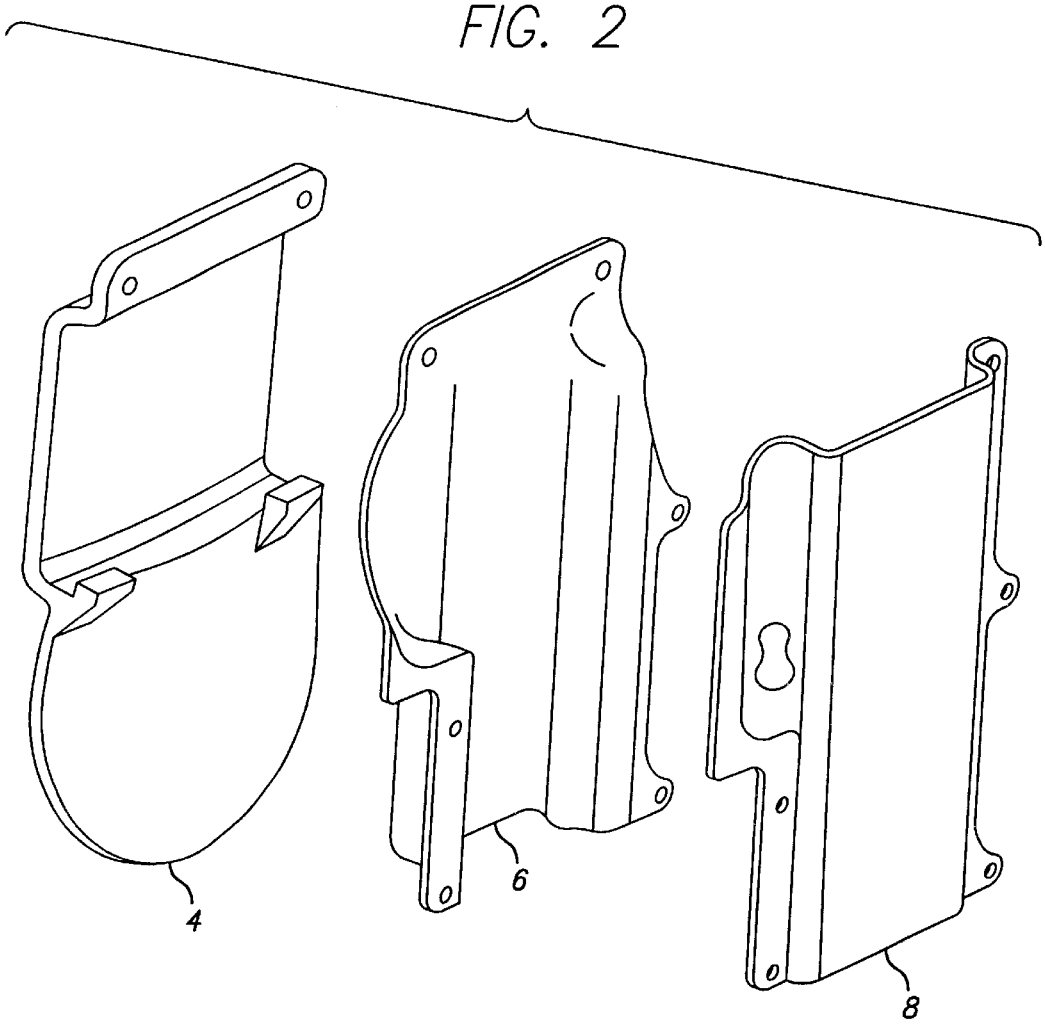
FIG. 2 illustrates an exploded side view of a hand gun holster and a retention member.

In FIG. 2 there is seen rigid plastic panel (6), rigid plastic panel (8) and retention member (4), before they are assembled and connected to each other.

In FIG. 3 there is seen a rigid plastic holster (19) for holding a magazine (not shown), in combination with a retention member (4). The holster (19) and retention member (4) are products of injection molding. The inner dimensions of holster (19) are complementary to the configuration of the outer dimensions/sections of a magazine for an automatic hand gun (not shown), to be placed therein. The holster (19) can be manufactured as one piece by injection molding, or as two pieces which are connected to each other. The illustrated holster (19) includes two rigid plastic panels (20) and (22). It should be noted that panels (20) and (22) may be connected by glue or the application of ultrasonic welding thereto. The retention member (4) enables the mounting of holster (19) on the upper rim of a user's pants (not shown). The member (4) has a lateral concave configuration (shown is the convex side (28) of the member), complementary to the convex configuration of a user's hip (not shown).

Retention in member (4) has a lateral step configuration (12) along the longitudinal axis thereof, whereby step (12) forms a ledge (13) that can underride a belt (not shown), and wherein the ledge of said step further comprises at least one upwardly extending flange (14) which is substantially parallel to said member (4) and substantially perpendicular to the ledge (13) of said step, thereby forming a hook-like configuration for hooking against the front surface of said belt, thereby enabling said belt to act as stop means preventing upward movement of said holster, while allowing the quick draw of a gun therefrom.

The holster (19) is connected to retention member (4) by rivets (30) and (32), however may be connected by glue or the application of ultrasonic welding.

In FIG. 4 there is seen rigid plastic panel (20), rigid plastic panel (22) and retention member (4), before they are connected to each other.

It will be evident to those skilled in the art that the invention is not limited to the details of the foregoing illustrative figures and that the present invention may be embodied in other specific forms without departing from the essential attributes thereof, and it is therefore desired that the present figures be considered in all respects as illustrative and not restrictive, reference being made to the appended claims, rather than to the foregoing description, and all changes which come within the meaning and range of equivalency of the claims are therefore intended to be embraced therein.

What is claimed is:

1. A rigid plastic hand gun clip-on holster, comprising a rigid plastic holster having inner dimensions complementary to the configuration of the outer sections of a hand gun to be placed therein, wherein said holster is a product of injection molding and wherein said holster further comprises a retention member for mounting said holster on the upper rim of the user's pants, wherein said retention member has a lateral step configuration along the longitudinal axis thereof, whereby said step forms a ledge that can underride a belt, and wherein the ledge of said step further comprises at least two spaced-apart upwardly extending flanges for hooking against the front surface of said belt, whereby said holster and said flanges are located forwardly at the front side of said belt thereby enabling said belt to act as stop means preventing upward movement of said holster, while allowing the quick draw of a gun therefrom.

2. A rigid plastic hand gun holster according to claim 1, wherein said holster comprises two rigid plastic panels.

3. A rigid plastic hand gun holster according to claim 2, wherein the cross-section of at least a segment of each of said panels is of substantially U-shaped configuration.

4. A rigid plastic hand gun holster according to claim 2, wherein said panels are connected by means selected from the group consisting of rivets and glue.

5. A rigid plastic hand gun holster according to claim 2, wherein said panels are connected by the application of ultrasonic welding thereto.

6. A rigid plastic gun holster according to claim 1, wherein said flanges form a pair of spaced-apart hooks.

7. A rigid plastic hand gun holster according to claim 1, wherein said retention member is made of rigid plastic.

8. A rigid plastic hand gun holster according to claim 1, wherein said retention member is connected to said holster by means selected from the group consisting of rivets and glue.

9. A rigid plastic hand gun holster according to claim 1, wherein said retention member is connected to said holster through the application of ultrasound thereto.

10. A rigid plastic hand gun holster according to claim 1, wherein the cross-section of at least a segment of said holster is substantially rectangular.

11. A rigid plastic hand gun holster according to claim 1, wherein said holster is custom-made to match the configuration of the outer sections of a specific hand gun model.

12. A rigid plastic hand gun holster according to claim 2, wherein at least one of said panels is provided with an indentation corresponding to the position of an opening of a trigger-guard of a handgun positioned therein, whereby said indentation releasably interlocks with said trigger guard to form a snap-fit therewith.

13. A rigid plastic hand gun holster according to claim 1, wherein said retention member is connected to said holster by glue.

14. A rigid plastic clip-on holster for holding a magazine for an automatic hand-gun, comprising a rigid plastic holster having inner dimensions complementary to the configuration of the outer sections of a magazine to be placed therein, wherein said holster is a product of injection molding and wherein said holster further comprises a retention member for mounting said holster on the upper rim of the user's pants, wherein said retention member has a lateral concave configuration complimentary to the convex configuration of said user's hip and wherein said retention member has a lateral step configuration along the longitudinal axis thereof, whereby said step forms a ledge that can underride a belt and wherein the ledge of said step further comprises at least two spaced-apart upwardly extending flanges for hooking against the front surface of said belt whereby said holster and said flanges are located forwardly at the front side of said belt thereby enabling said belt to act as stop means preventing upward movement of said holster, while allowing the quick withdrawal of a magazine therefrom.

15. A rigid plastic holster for holding a magazine according to claim 14, wherein said magazine holster comprises two rigid plastic panels.

16. A rigid plastic holster for holding a magazine according to claim 15, wherein said panels are connected by means selected from the group consisting of rivets and glue.

17. A rigid plastic holster for holding a magazine according to claim 15, wherein said panels are connected by the application of ultrasonic welding thereto.

18. A rigid plastic holster for holding a magazine according to claim 14, wherein said retention member is made of rigid plastic.

19. A rigid plastic holster for holding a magazine according to claim 14, wherein said retention member is connected to said holster by means selected from the group consisting of rivets and glue.

20. A rigid plastic holster for holding a magazine according to claim 14, wherein said retention member is connected to said holster through the application of ultrasonic welding thereto.

* * * * *